United States Patent [19]

Hayashi et al.

[11] Patent Number: 4,583,103

[45] Date of Patent: Apr. 15, 1986

[54] HEAT-SENSITIVE RECORDING PAPER

[75] Inventors: Takayuki Hayashi; Hiroharu Matsukawa; Kensuke Ikeda, all of Shizuoka, Japan

[73] Assignee: Fuji Photo Film Co., Ltd., Kanagawa, Japan

[21] Appl. No.: 739,589

[22] Filed: May 30, 1985

[30] Foreign Application Priority Data

May 31, 1984 [JP] Japan ..... 59-111729

[51] Int. Cl.[4] ..... B41M 5/18

[52] U.S. Cl. ..... 346/209; 346/200; 346/226; 427/152; 428/446; 428/447; 428/514; 428/522

[58] Field of Search ..... 346/200, 207, 208, 209, 346/226; 427/150, 151, 152; 428/207, 341, 342, 514, 522, 913, 914, 446, 447

[56] References Cited

FOREIGN PATENT DOCUMENTS

| | | | |
|---|---|---|---|
| 0128349 | 10/1979 | Japan | 346/226 |
| 0027394 | 3/1981 | Japan | 346/226 |
| 0074195 | 5/1982 | Japan | 346/226 |
| 2119531A | 11/1983 | United Kingdom | 346/226 |

*Primary Examiner*—Bruce H. Hess

*Attorney, Agent, or Firm*—Sughrue, Mion, Zinn, MacPeak and Seas

[57] ABSTRACT

A heat-sensitive recording paper is disclosed, comprising a base having thereon (a) a heat-sensitive color forming layer containing a substantially colorless electron donating dye and an acid substance capable of forming a coloration by coming into contact with said dye upon heating, wherein a coating layer containing a binder comprising modified polyvinyl alcohol containing silicon atoms in the molecule and at least one of colloidal silica and amorphous silica is provided on said color forming layer.

8 Claims, No Drawings

HEAT-SENSITIVE RECORDING PAPER

FIELD OF THE INVENTION

The present invention relates to a heat-sensitive recording paper for recording by a heat pen or a thermal head, etc., and, particularly, to a heat-sensitive recording paper with reduced fog, improved recording image permanence; reduced adhesion (blocking), and reduced sticking and fouling of thermal heads.

BACKGROUND OF THE INVENTION

In heat-sensitive recording papers, a recording image is obtained by a physical or chemical change of substances caused by heat energy, and a number of such thermal processes are known.

Recently, the heat-sensitive recording papers have been used to record the output of a facsimile or coomputer output, which provide primary color formation with no requirement of development. Such dye type papers are disclosed in Japanese Patent Publication Nos. 4160/68 and 14039/70 and Japanese Patent Application (OPI) No. 27253/80 (corresponding to U.S. Pat. No. 4,283,458) (The term "OPI" as used herein refers to a "published unexamined Japanese Patent Application".)

Generally, when a heat-sensitive recording paper is used as a recording paper, the advantage of a small and light recording apparatus is obtained. Accordingly, such papers have become widely used. On the other hand, conventional heat-sensitive recording papers have the disadvantage that the recorded image can be erased by adhesion of various chemicals or oils, and the paper are easily fogged. Since these faults are serious problems in practical use, improvement has been attempted and in particular it is common to provide a protective layer on a heat-sensitive layer.

In Japanese Patent Publication No. 27880/69, is disclosed a layer containing a non-sticky lubricant melting at a temperature lower than the operation temperature and dispersed in a water soluble polymer such as polyvinyl alcohol. The layer is provided on a heat-sensitive color forming layer to prevent fouling of the surface of the mark (heat) during heating. However in this process, resistance to various chemicals or oils and resistance to water are insufficient.

Further, it has the disadvantage of sticking when used for facsimiles.

In order to remedy the above-described problems of heat-sensitive recording papers having a protective layer, by improving resistance to various chemicals, water resistance, sticking, pressure fog or adhesion of scums, it has been proposed to use hydrophobic polymeric substances and various water soluble polymers which can be used together with water proofing agents or with fillers. (Japanese Patent Application Nos. (OPI) 30437/73, 31958/73, 19840/78, 14751/79, 53545/79, 11837/79, 128349/79, 126193/81, 139993/81, 10530/82 (corresponding to U.S. Pat. No. 4,346,343), 29491/82, 1053925/82, 115391/82 (corresponding to U.S. Pat. No. 4,415,627), 144793/82 (corresponding to U.S. Pat. No. 4,444,819), 107884/82, 53484/83 and 193189/83).

However, these processes have the drawbacks that resistance to various chemicals, oils and water remains insufficient, sensitivity is reduced, sticking properties are insufficient, blocking, for example adhesion in case of interpoosition of water between surface/surface or surface/back face, is caused, and complicated production steps are required, thus increasing the cost. Consequently, they are not on the whole acceptable in industrial use.

SUMMARY OF THE INVENTION

An object of the present invention is to provide an industrially advantageous heat-sensitive recording paper providing good printing density, resistance to various chemicals, oils and water, anti-sticking and antiblocking properties.

These and other objects of the present invention have been attained by a heat-sensitive recording paper comprising a base having thereon (a) a heat-sensitive color formation layer containing a substantially colorless electron donating dye and an acid substance capable of forming a coloration by coming into contact with said dye up on heating and (b) a coating layer thereon containing a binder comprising modified polyvinyl alcohol having silicon atoms and colloidal silica and/or amorphous silica, as main components, in that sequence.

DETAILED DESCRIPTION OF THE INVENTION

The modified polyvinyl alcohol containing silicon atoms in the molecule that can be used in the present invention is not particularly restricted, if it contains silicon atoms in the molecule. However, generally suitable polyvinyl alcohols contain silicon atoms having reactive substituents such as an alkoxyl group, an acyloxy group, a hydroxyl group obtained by hydrolysis, or an alkali metal base.

Details of processes for producing modified polyvinyl alcohols having silicon atoms in the molecule are described in Japanese Patent Application (OPI) No. 193189/83. Modified polyvinyl alcohols containing silicon atoms in the molecule used in the present invention can be produced by these known processes.

The following summary of such processes is provided. The process for producing the modified polyvinyl alcohol used in the present invention is not restricted to those described in the above described patent application, and any other conventional processes may be used.

(a) A process which comprises introducing silicon atoms into polyvinyl alcohol or modified polyvinyl acetate having carboxyl groups or hydroxyl groups by post-conversion with a silylating agent.

(b) A process which comprises saponifying a copolymer of a vinyl ester and an olefinically unsaturated monomer containing a silicon atom.

Process (a) is carried out, for example, as follows.

A silylating agent is dissolved in an organic solvent which does not react with the silylating agent. In this solution, polyvinyl alcohol or modified polyvinyl acetate containing carboxyl groups or hydroxyl groups is suspended, and the suspension is heated to a temperature between room temperature and the boiling point of the silylating agent. The polyvinyl alcohol or polyvinyl acetate reacts with the silylating agent, by which modified polyvinyl alcohol containing silicon atoms in the molecule is obtained. The vinyl acetate is optionally further saponified with an alkali catalyst.

Silylating agents used in this process include organohalogenosilanes, organosilicone esters, organoalkoxysilanes, organosilanols, aminoalkylsilanes and organosilicon isocyanates. The introduction rate of the silylating agent, i.e., the conversion rate, can be suitably controlled by controlling the amount of the silylating agent used and the reaction time.

Process (b) is carried out, for example, as follows.

A vinyl ester and an olefinically unsaturated monomer containing a silicon atom in the molecule are copolymerized in alcohol in the presence of a radical polymerization initiator. To a solution of the resulting copolymer in alcohol, an alkali or acid catalyst is added to saponify the copolymer, by which a modified polyvinyl alcohol containing silicon atoms in the molecule can be obtained.

Vinyl esters that can be used in this process, include vinyl acetate and vinyl propionate. However, vinyl acetate is preferred from the viewpoint of economy. Olefinically unsaturated monomers containg a silicon atom in the molecule that can be used in this process include vinylsilanes represented by general formula (I) and (meth)acrylamide-alkylsilanes represented by general formula (II):

$$CH_2{=}CH{-}(CH_2)_n{-}\underset{\underset{R_m^1}{|}}{Si}{-}(R^2)_{3-m} \quad (I)$$

$$CH_2{=}CR^3{-}\overset{\overset{R^4}{|}}{\underset{\underset{O}{\|}}{C}}N{-}R^5{-}\underset{\underset{R_m^1}{|}}{Si}{-}(R^2)_{3-m} \quad (II)$$

wherein n is 0 to 4, m is 0 to 2, $R^1$ represents an alkyl group having 1 to 5 carboon atoms, $R^2$ represents an alkoxy group having 1 to 40 carbon atoms or an acyloxy group (wherein the alkoxy group or the acyloxy group may have an oxygen containing substituent), $R^3$ represents a hydrogen atoms or a methyl group, and $R^4$ represents a hydrogen atom, an alkylene group having 1 to 5 carbon atoms or a divalent organic residue in which chain carbon atoms are bonded with oxygen or nitrogen; provided that when the monomer contains two or more of $R^1$, $R^1$ may be the same or different; and, when the monomer contains two or more of $R^2$, $R^2$ may be the same or different.

Examples of vinylsilanes represented by general formula (I) include vinyltrimethoxysilane, vinyltriethoxysilane, vinyltris-(β-methoxyethoxy)silane, vinyltriacetoxysilane, allyltrimethoxysilane, allyltriacetoxysilane, vinylmethoxydiacetoxysilane, vinyldimethoxymethylsilane, vinyldimethylethoxysilane, vinylmethyldiacetoxysilane, vinyldimethylacetoxysilane, vinylisobutyldimethoxysilane, vinyltriisopropoxysilane, vinyltributoxysilane, vinyltrihexyloxysilane, vinylmethoxydihexyloxysilane, vinyltrioctyloxysilane, vinyldimethoxyoctyloxysilane, vinyldimethoxydioctyloxysilane, vinylmethoxydilauryloxysilane, vinyldimethoxylauryloxysilane, vinylmethoxydioleyloxysilane, vinyldimethoxyoleyloxysilane and polyethylene glycolated vinylsilanes represented by the general formula $$CH_2{=}CH{-}\underset{\underset{R_m^1}{|}}{Si}{-}((O{-}CH_2CH_2)_x{-}OH)_{3-m}$$

(wherein $R^1$ and m are each defined as above, and x represents 1 to 20).

Examples of acrylamide-alkylsilanes and methacrylamide-alkylsilanes represented by general formulla (II) include 3-(meth)acrylamide-propyltrimethoxysilane, 3-(meth)acrylamide-propyltriethoxysilane, 3-(meth)acrylamidepropyltri-(β-methoxyethoxy)silane, 2-(meth)acrylamide-2-methylpropyltrimethoxysilane, 2-(meth)acrylamide-2-methylethyltrimethoxysilane, N-(2-(meth)acrylamide-ethyl)-aminopropyltrimethoxysilane, 3-(meth)acrylamide-propyltriacetoxysilane, 2-(meth)acrylamide-ethyltrimethoxysilane, 1-(meth)acrylamide-methyltrimethoxysilane, 3-(meth)acrylamidepropylmethyldimethoxysilane, 3-(meth)acrylamide-propyldimethylmethoxysilane and 3-(N-methyl-(meth)acrylamide-propyltrimethoxysilane.

Modified polyvinyl alcohols having silicon atoms can be used in the present invention allone or in combination. When copolymerizing a vinyl ester and an olefinically unsaturated monomer containing a silicon atom in the molecule, other unsaturated monomers capable of copolymerizing with such monomers may optionally also be present in the copolymer in addition to the above described two coomponents.

As the modified poolyvinyl alcohol containing silicon atoms in the molecule used in the present invetion, saponified products of a copolymer of an olefinically unsaturated monomer containing a silicon atom in the molecule represented by general formula (I) and vinyl acetate, prepared by the process (b) are preferred. A saponified product of a copolymer of vinyltrimethoxysilane and/or vinyltributoxysilane represented by the general formula (I) and vinyl acetate is particularly preferred.

The silicon atom content in the modified polyvinyl alcohol containing silicon atoms in the molecule obtained by the above described processes, can be suitably selected in a broad range according to the state of use, but it is generally present in a range of about 0.01 to 10% by mol, preferably, about 0.1 to 2.5% by mol, calculated as the olefinically unsaturated monomer unit containing a silicon atom.

The degree of polymerization of the modified polyvinyl alcohol having ssilicon atoms in the molecule is not particularly restricted, but it is generally in a range of about 250 to 3000, preferably, about 300 to 2000, and most preferably, about 500 to 2000. The degree of saponification of the vinyl acetate unit is not subject to restriction, but is preferably in a range of about 70 to 100% by mol.

The colloidal silica and/or amorphous silica used in the present invention together with the modified polyvinyl alcohol containing silicon atoms are those produced industrially. Colloidal silica is a colloidal solution obtained by dispersing very fine grains of silicic acid anhydride in water as a dispersion medium. Grains are preferred to have a particle size of about 10 mμ to 100 mμ and a specific gravity of about 1.1 to 1.3. In this case, a colloidal solution having a pH value of about 4 to 10 is suitably used.

Amorphous silica is produced industrially by a wet process or a gaseous phase process. It is preferred to use amorphous silica having a primary grain size of about 10 to 30 μm, a secondary grain size of about 0.5 to 10 μm, an oil absorption amount (JIS K5101) of about 150 to 300 ml/100 g, an apparent specific gravity (JIS K6223) of about 0.1 to 0.3 g/ml, and a pH (5 wt % aqueous suspension) of about 6 to 10.

In order to form a protective layer using the above described silicon-containing polyvinyl alcohol and colloidal silica and/or amorphous silica, a mixture having a suitable ratio is applied to a heat-sensitive color forming layer according to the conventional coating methods, for example, air knife coating method, bar coating method, curtain coating method, blade coating method, etc.

A suitable mixing rate of colloidal silica and/or amorphous silica to silicon-containing polyvinyl alcohol is in a range of about 0.05 to 10 parts by weight, preferably about 0.1 to 5 parts by weight, more preferably about 0.2 to 2 parts by weight of colloidal silica and/or amorphous silica, based on 1 part by weight of the silicon-containing polyvinyl alcohol. The coating amount of the protective layer is in a range of about 0.2 to 5.0 $g/m^2$, preferably about 0.5 to 3 $g/m^2$, calculated as solid component.

If the coating amount is too small, resistance to various chemicals is inferior and, if the coating amount is too large, the thermal response of the heat-sensitive color forming layer deteriorates. Therefore, the coating amount can be determined according to both performance requirements.

Further, binders used conventionally, such as polyvinyl alcohol, methyl cellulose, starch, carboxymethyl cellulose, styrene-maleic acid copolymer, diisobutylenemaleic acid copolymer, polyamide resin or polyacrylamide resin optionally may be used in the coating layer according to the invention. In the coating layer, an inorganic pigment, a metal soap, a wax or a surface-active agent may be contained.

The heat-sensitive color forming layer of the heat-sensitive paper according to the present invention is prepared by applying a coating solution generally used in this field which is composed of a substantially colorless electron donating dye (color former), an acid substance (color developer), a heat-fusible substance, an organic or inorganic pigment, a binder and, if desired, a metal soap or wax to a paper or synthetic resin film base.

The color former and the color developer are separately dispersed in a water soluble poolymer (binder) by means of a ball mill, etc. Dispersion is carried out until a volume average particle size of the color former and color developer is achieved to 5 μm or less, preferably, 2 μm or less. After conclusion of dispersion, the two solutions are blended to prepare a heat-sensitive coating solution.

Color formers used in the present invention include triarylmethane compounds, diphenylmethane compounds, xanthene compounds, thiazine compounds and spiropyran compounds. Triarylmethane compounds include 3,3-bis-(p-dimethylaminophenyl)-6-dimethylaminophthalide (i.e., Crystal Violet llactone), 3,3-bis-(p-dimethylaminophenyl)-phthalide, 3-(p-dimethylaminophenyl)-3-(1,3-dimethylindol-3-yl)phthalide and 3-(p-dimethylaminophenyl)-3-(2-methylindol-3-yl)phthalide. Diphenylmethane compounds include 4,4'-bis-dimethylaminobenzohydrin benzyl ether, N-halo-phenyl-leuco Aurammine, N-2,4,5-trichlorophenyl leuco Auramine, etc. Xanthene compounds include Rhodamine-B-anilinolactam, Rhodamine (p-nitroanilino)-lactam, Rhodamine B-(p-chloroanilino)-lactam, 2-dibenzylamino-6-diethylaminofluoran, 2-anilino-6-diethylaminofluoroan, 2-anilino-3-methyl-6-diethylaminofluoran, 2-anilino-3-methyl-6-N-cyclohexyl-N-methylaminofluoran, 2-anilino-3-methyl-6-N-ethyl-N-isoamylaminofluoran, 2-o-chloroanilino-6-diethyl-aminofluoran, 2-m-chloroanilino-6-diethylaminofluoran, 2-(3,4-dichloroanilino)-6-diethylaminofluoran, 2-octylamino-6-diethylaminofluoran, 2-dihexylamino-6-diethylaminofluoran, 2-m-trichloromethylanilino-6-diethylaminofluoran, 2-butylamino-3-chloro-6-diethylaminofluoran, 2-ethoxyethylamino-3-chloro-6-diethylaminofluoran, 2-anilino-3-chloro-6-diethylaminofluoran, 2-diphenylamino-6-diethylaminofluoran, 2-anilino-3-methyl-6-diphenylaminofluoran, 2-anilino-3-methyl-5-chloro-6-diethylaminofluoran, 2-anilino-3-methyl-6-diethylamino-7-methylfluoran, 2-anilino-3-methoxy-6-dibutylaminofluoran, 2-o-chloroanilino-6-dibutylaminofluoran, 2-p-chloroanilino-3-ethoxy-6-diethylaminofluoran, 2-phenyl-6-diethylaminofluoran, 2-o-chloroanilino-6-p-butylanilinofluoran, 2-anilino-3-pentadecyl-6-diethylaminofluoran, 2-anilino-3-ethyl-6-dibutylaminofluoran, 2-anilino-3-ethyl-6-N-ethyl-N-isoamylaminofluoran, 2-anilino-3-methyl-6-N-ethyl-N-γ-methoxypropylaminofluoran, 2-anilino-3-phenyl-6-diethylaminofluoran, 2-diethylamino-3-phenyl-6-diethylaminofluoran, and 2-anilino-3-methyl-6-N-isoamyl-N-ethylaminofluoran. Thiazine compounds include benzoyl leuco Methylene Blue and p-nitrobenzyl leuco Methylane Blue. Spiro compounds include 3-methyl-spiro-dinaphthopyran, 3-ethyl-spiro-dinaphthopyran, 3,3'-dichloro-spirodinaphthopyran, 3-benzyl-spiro-dinaphthopyran, 3-methyl-naphtho(3-methoxybenzo)-spiropyran and 3-propyl-spiro-dibenzopyran. The above color former can be used alone or in combination.

Color developers used in the present invention include bisphenols such as 2,2-bis-(4'-hydroxyphenyl)-propane(bisphenol A), 2,2-bis-(4-hydroxyphenyl)pentane, 2,2-bis-(4'-hydroxy-3',5'-dichlorophenyl)propane, 1,1-bis-(4'-hydroxyphenyl)cyclohexane, 2,2-bis(4'-hydroxyphenyl)hexane, 1,1-bix(4'-hydroxyphenyl)propane, 1,1-bis(4'-hydroxyphenyl)-butane, 1,1-bis(4'-hydroxyphenyl)pentane, 1,1-bis(4'-hydroxyphenyl)hexane, 1,1-bis(4'-hydroxyphenyl)heptane, 1,1-bis(4'-hydroxypenyl)octane, 1,1-bis(4'-hydrooxyphenyl)-2-methyl-pentane, 1,1-bis(4'-hydroxyphenyl)-2-ethyl-hexane or 1,1-bix(4'-hydroxyphenyl)dodecane; salicylic acids such as 3,5-di-α-methylbezylsalicylic acid, 3,5-di-tertiary butylsalicylic acid or 3-α,α-dimethylbenzylsalicylic acid, and polyvalent metal salts thereof (particularly, zinc salts and aluminium salts are preferred); oxybenzoic acid esters such as benzyl p-hydroxybenzoate or 2-ethylhexyl p-hydroxybenzoate; and phenols such as p-phenylphenol, 3,5-diphenylphenol or cumylphenol. Bisphenols are particularly preferred.

A binders, compounds dissolving in an amount of about 5 wt % or more in water at 25° C. are suitably used. Examples thereof include methyl cellulose, carboxymethyl cellulose, hydroxyethyl cellulose, starch, gelatin, gum arabic, casein, styrene-maleic acid anhydride copolymer hydrolyzates, ethylene-maleic acid anhydride copolymer hydrolyzates, isobutylene-maleic acid anhydride copolymer hydrolyzates, polyvinyl alcohol and carboxyl modified polyvinyl alcohol.

As oil absorbing pigments, inorganic pigments such as zinc oxide, calcium carbonate, barium sulfate, titanium oxide, lithopone, talc, agalmatolite, kaolin, aluminium hydroxide and calcined kaolin and organic pigments such as urea-formaldehyde resin and polyethylene powder, are optionally used.

As metal soaps, higher aliphatic acid metal salts are optionally used. Zinc stearate, calcium stearate, aluminum stearate, can be used.

Waxes including polyethylene wax, carnauba wax, paraffin wax, microcrystalline wax and aliphatic acid amide are optionally used.

If desired antioxidants, ultraviolet light absorbing agents and agents for improving image preservability can be added.

Suitable agents for improving image preservability include phenols substituted by an alkyl group at least the 2- or 6-position, and their derivatives. Particularly, phenols substituted by a branched alkyl group at one or more of the 2- or 6- positions and their derivatives are preferred. Further, compounds having a plurality of phenol groups in the molecule are preferred and, particularly, those having 2 or 3 phenol groups are preferred.

The coating solution is applied to a paper base or support such as neutral paper, wood free paper or plastic film, and dried. In case of preparing the coating solution, all components may be initially blended and then divided dispersed, or may be first separately dispersed and then blended into a suitable combination, respectively.

When paper is used as the support, it is preferred to provide a thin resin layer on the reverse side of the heat-sensitive color forming layer or the formation layer on the base, in view of curl balance.

In the following, specific examples illustrating embodiments of the present invention in detail are described. However, the present invention should not construed as being limited to these examples in any way. Unless otherwise indicated, all parts, percents and ratios are by weight.

EXAMPLE 1

10 g of 2-anilino-3-methyl-6-N-cyclohexyl-N-methylaminofluoran as an electron donating colorless dye and 25 g of a 10% aqueous solution of polyvinyl alcohol (saponification value: 98%, degree of polymerization: 1000) were processed together with 25 g of water in a ball mill for 24 hours to obtain a dispersion (A) having an average particle size of 1.5 μm.

Likewise, 10 g of benzyl p-oxybenzoate, 5 g of 2,2'-methylene-bis-(4-methyl-6-tert-butylphenol), 15 g of calcium carbonate (Brilliant 15, produced by Shiraishi Kogyo Co.) and 25 g of a 10% aqueous solution of polyvinyl alcohol (saponification value: 98%, degree of polymerization: 1000) were processed together with 50 g of water in a ball mill for 24 hours to obtain a dispersion (B) having an average particle size of 1.5 μm.

Dispersion (A) and dispersion (B) were blended in a ratio by weight of 1:3. To 200 g of the resulting mixture, 15 g of a 21% aqueous dispersion of zinc stearate was added and dispersed therein to prepare a heat-sensitive color forming layer coating solution.

The thus prepared heat-sensitive color forming layer coating solution was applied to a base paper having an areal weight of 47 g/m$^2$ in a coating amount having a solid content of 5 g/m$^2$, and dried at 60° C. for 1 minute to produce a heat-sensitive color forming layer on the base paper.

To the resulting heat-sensitive color forming layer, a coating solution for coating layer prepared as follows was applied in a coating amount having a solid content of 2.5 g/m$^2$, dried at 50° C. for 2 minutes to form a coating layer, and subjected to calender processing to obtain a heat-sensitive recording paper according to the present invention which had a smoothness of 850 seconds (JIS P8119).

Preparation of Coating Solution for Coating Layer:

| | |
|---|---|
| 10% Aqueous solution of silicon-containing modified polyvinyl alcohol (vinyltrimethoxysilane-vinyl acetate copolymer, which contained 0.5% by mol of silicon as a vinylsilane unit, wherein the saponification value of vinyl acetate was 98.3% and the degree of polymerization was about 500) | 70 g |
| 20% Colloidal silica (Snowtex C produced by Nissan Chemical Industries, Ltd.) | 12.5 g |
| 50% Kaolin dispersion | 10 g |
| 21% Paraffin wax dispersion (average carbon atom number 30) | 2.5 g |
| 30% Zinc stearate dispersion | 1.5 g |

The above components were blended to prepare a coating solution for coating layer.

EXAMPLE 2

A heat-sensitive recording paper was prepared in the same manner as in Example 1, except that a coating solution for the coating layer having the following formulation was used.

| | |
|---|---|
| 5% Aqueous solution of silicon-containing modified polyvinyl alcohol (vinyltrimethoxysilane-vinyl acetate copolymer, which contained 0.5% by mol of silicon as a vinylsilane unit, wherein saponification value of vinyl acetate unit was 98.5% and the degree of polymerization was about 1000) | 50 g |
| 25% Aqueous solution of polyamide | 5 g |
| 20% Calcium processed amorphous silica (Oil absorption value: 150 ml/100 g JIS K5101) | 10 g |
| 50% Calcium carbide dispersion | 10 g |
| 30% Zn stearate dispersion | 1.5 g |
| 20% Stearic acid amide dispersion | 2.5 g |

The above components were blended to prepare a coating solution for coating layer.

EXAMPLE 3

10 g of 2-anilino-3-methyl-6-N-isoamyl-N-ethylaminofluoran as an electron donating colorless dye and 25 g of a 10% aqueous solution of polyvinyl alcohol (saponification value: 98%, degree of polymerication 500) were processed together with 25 g of water in a ball mill for 24 hours to prepare a dispersion (A).

Likewise, 20 g of 1,1-bis-(4-hydroxyphenyl)cyclohexane, 15 g of stearic acid amide, 20 g of calcined kaolin and 25 g of a 10% aqueous solution of polyvinyl alcohol (saponification value: 98%, degree of polymerization: 1000) were processed together with 50 g of water in a ball mill for 24 hours to prepare a dispersion (B).

Dispersion (A) and the dispersion (B) were blended in a ratio by weight of 1:1. To 200 g of the resulting mixture, 15 g of a 21% aqueous zinc stearate dispersion was added and sufficiently dispersed to prepare a heat-sensitive color forming layer coating solution.

The prepared heat-sensitive color forming layer coating solution was applied to a base paper having an area weight of 45 g/m$^2$ in a coating amount having a solid content of 5 g/m$^2$, and dried at 60° C. for 1 minute to prepare a heat-sensitive color forming layer on the base paper.

To the resulting heat-sensitive color forming layer, the coating solution for the coating layer described in Example 1 was applied in a coating amount having a solid content of 0.5 g/m$^2$, dried at 50° C. for 2 minutes to form a coating layer, and subjected to calender processing to obtain a heat-sensitive recording paer according to the present invention which had a smoothness of 1200 seconds.

COMPARATIVE EXAMPLES 1 and 2

Heat-sensitive recording papers for comparison were obtained by the same manner as in Examples 1 and 3, respectively, except that the coating layer was not provided.

COMPARATIVE EXAMPLES 3 to 7

Heat-sensitive recording papers for comparison were obtained, respectively, by the same manner as in Example 1, except that in each case a coating layer was formed with the following coating solutions.

Comparative Example 3

20% Colloidal silica dispersion alone
Coating amount 2.5 g/m$^2$
(solid content)

Comparative Example 4

| | |
|---|---|
| 7% Aqueous solution of silicon-containing modified polyvinyl alcohol used in Example 1 | 70 g |
| 50% Kaolin dispersion | 10 g |
| Coating amount (solid content) | 2.5 g/m$^2$ |

Comparative Example 5

| | |
|---|---|
| 1% Aqueous solution of alginic acid | 500 g |
| 50% Kaolin dispersion | 10 g |
| Coating amount (solid content) | 2.5 g/m$^2$ |

Comparative Example 6

| | |
|---|---|
| 10% Aqueous solution of polyvinyl alcohol (saponification value: 97%, degree of polymerization: about 1000) | 50 g |
| 50% Kaolin dispersion | 50 g |
| Coating amount (solid content) | 2.5 g/m$^2$ |

Comparative Example 7

| | |
|---|---|
| 10% Aqueous solution of carboxyl modified polyvinyl alcohol (carboxyl modification value: about 5%) | 50 g |
| 50% Kaolin dispersion | 50 g |
| Coating amount (solid content) | 2.5 g/m$^2$ |

Comparison of the heat-sensitive recording papers according to the invention and comparative recording papers was carried out as follows.

(1) Fog and Color Forming Properties

Recording was carried out by applying an energy of 2 ms/dot and 50 mJ/m$^2$ to a recording element at a density of chief scanning of 5 dots/mm and sub-scanning of 6 dots/mm. Fog (density before recording) and color density after recording (initial density) were measured by a reflection densitomer: Macbeth RD-514 (using a visual filter).

(2) Resistance to Office Supplies, Cosmetics, Various Chemicals and Oils

Resistance of uncolored portions of the heat-sensitive recording paper to fluorescent pens, marking ink, aqueous paste, diazo developing solution, ethanol and hair cosmetic (i.e. fog), resistance to aqueous ink and cinnabar seal ink (i.e. blot) and resistance of colored portions to cellophane tapes, hand cream, a polyvinyl chloride sheet and castor oil (vanishing of color) were measured.

(3) Running aptitude for heat-sensitive facsimile

Using a heat-sensitive recording paper processed in a heat-sensitive facsimile (Matsushita Denso: UF-920), tests of printing, sticking and adhesion of scums causing fouling of the head were carried out.

(4) Blocking

5 μl of water was dropped on the surface of a recording paper, and an uncoated base paper was put on it. After being dried in the air for 1 hour, the base paper was stripped off, and adhesive strength between the recording paper and the base paper was examined. (It is preferable that adhesion is not caused).

Results of the above tests are shown in Table 1. From these data it is understood that the heat-sensitive recording papers according to the present invention are excellent in resistance to various office supplies and oils and are excellent in sticking, adhesion to the thermal head and blocking, though their color formation (density) is slightly inferior to that of the heat-sensitive recording papers having no coating layer of the comparative examples.

TABLE 1

| | | | Fog on Uncolored Portions due to Various Office Supplies, Cosmetics, Chemicals and Oils | | | | | | | Blot | |
|---|---|---|---|---|---|---|---|---|---|---|---|
| | Color Density | Fog | Fluorescent Pen A | Fluorescent Pen B | Marking Ink | Aqueous Paste | Diazo-Developing Solution | Ethanol | Hair Cosmetic | Aqueous Pen | Cinnabar Seal Ink |
| Example | | | | | | | | | | | |
| 1 | 1.05 | 0.09 | O | O | O | O | O | O | O | O | O |
| 2 | 1.08 | 0.09 | O | O | O | O | O | O | O | O | O |
| 3 | 0.90 | 0.07 | O | O | O | O | O | O | O | O | O |
| Comparative Example | | | | | | | | | | | |
| 1 | 1.15 | 0.08 | X | X | X | X | X | X | X | O | O |
| 2 | 0.98 | 0.06 | Δ | Δ | Δ | Δ | Δ | Δ | Δ | O | O |
| 3 | 1.06 | 0.09 | Δ | Δ | X | Δ | X | X | Δ | Δ | O |
| 4 | 1.02 | 0.09 | O | O | O | Δ | Δ | Δ | Δ | O | O |
| 5 | 1.00 | 0.09 | O | O | O | O | O | O | O | O | O |
| 6 | 1.03 | 0.09 | O | O | O | O | O | O | O | X | Δ |

TABLE 1-continued

| | | | | | | | | | | | |
|---|---|---|---|---|---|---|---|---|---|---|---|
| 7 | 1.03 | 0.09 | O | O | Δ | O | Δ | Δ | Δ | Δ | O |

| | Color Density | Fog | Blot Stamp | Vanishing of color in colored portions: Cellophane Tape | Hand Cream | Polyvinyl Chloride Sheet | Castor Oil | Sticking | Fouling of Head | Blocking |
|---|---|---|---|---|---|---|---|---|---|---|
| Example | | | | | | | | | | |
| 1 | O | O | O | O | O | O | O | O | | |
| 2 | O | O | O | O | O | O | O | O | | |
| 3 | O | O | O | O | O | O | O | O | | |
| Comparative Example | | | | | | | | | | |
| 1 | O | X | X | X | X | Δ | X | Δ | | |
| 2 | O | Δ | Δ | X | X | Δ | X | Δ | | |
| 3 | O | Δ | Δ | X | X | X | Δ | Δ | | |
| 4 | O | Δ | Δ | Δ | Δ | X | O | Δ | | |
| 5 | Δ | O | O | Δ | Δ | X | O | X | | |
| 6 | Δ | Δ | Δ | Δ | Δ | X | O | X | | |
| 7 | Δ | Δ | Δ | Δ | Δ | X | O | X | | |

Note:
Fluorescent Pen A: Pilot spot writer
Fluorescent Pen B: Zebra pens
Aqueous paste: Yamato Glustick
Diazo developing solution: Ricoh super dry
Hair cosmetic: Kanebo Eroika Hair Liquid
Aqueous pen: Pilot puti red
Stamp: Shachihata
Hand cream: Kao soap nibea
Marking ink: Red No. 500
Evaluation
O: No problem in practical use
Δ: A slight problem in practical use
X: Bad for practical use.

While the invention has been described in detail and with reference to specific embodiments thereof, it will be apparent to one skilled in the art that various changes and modifications can be made therein without departing from the spirit and scope thereof.

What is claimed is:

1. A heat-sensitive recording paper comprising a base having thereon a heat-sensitive color forming layer containing a substantially colorless electron donating dye and an acid substance capable of forming a coloration by coming into contact with said dye upon heating, wherein a coating layer containing a binder comprising modified polyvinyl alcohol containing silicon atoms in the molecule and at least one of colloidal silica and amorphous silica is provided on said color forming layer.

2. The heat-sensitive recording paper as claimed in claim 1, wherein said modified polyvinyl alcohol comprises a copolymer of a vinyl ester and an olefinically unsaturated monomer containing a silicon atom.

3. The heat-sensitive recording paper as claimed in claim 2, wherein said copolymer is a copolymer of vinyl acetate and an olefinically unsaturated monomer represented by general formula (I) or (II):

$$CH_2{=}CH{-}(CH_2)_n{-}\underset{\underset{R_m^1}{|}}{Si}{-}(R^2)_{3-m} \quad (I)$$

$$CH_2{=}CR^3{-}\underset{\underset{O}{\|}}{\overset{\overset{R^4}{|}}{CN}}{-}R^5{-}\underset{\underset{R_m^1}{|}}{Si}{-}(R^2)_{3-m} \quad (II)$$

wherein n is 0 to 4, m is 0 to 2, $R^1$ represents an alkyl group having 1 to 5 carbon atoms, $R^2$ represents an alkoxy group having 1 to 40 carbon atoms, an acyloxy group, an alkoxy group having 1 to 40 carbon atoms substituted with an oxygen-containing substituent, or an acyloxy group substituted with an oxygen-containing substituent, $R^3$ represents a hydrogen atom or a methyl group, and $R^4$ represents a hydrogen atom, an alkylene group having 1 to 5 carbon atoms or a divalent organic residue in which chain carbon atoms are bonded with oxygen or nitrogen; provided that when the monomer contains two or more of $R^1$, $R^1$ may be the same or different; and, when the monomer contains two or more of $R^2$, $R^2$ may be the same or different.

4. The heat-sensitive recording paper as claimed in claim 1, wherein said colloidal silica contains silica grains having an average particle size of from about 10 mμ to 100 mμ, the specific gravity of said grains being from about 1.1 to 1.3, and the pH of the colloidal solution being of from about 4 to 10, and the amorphous silica has a primary grain size of from about 10 to 30 μm, a secondary grain size from about 0.5 to 10 μm, an oil absorption amount of from about 150 to 300 ml/100 g, an apparent specific gravity of about 0.1 to 0.3 g/ml and a pH in 5 wt % aqueous suspension of about 6 to 10.

5. A heat-sensitive recording paper as claimed in claim 1, wherein the total amount of colloidal silica and amorphous silica in said coating layer is from about 0.05 to 10 parts by weight, based on 1 part by weight of said modified polyvinyl alcohol containing silicon.

6. A heat-sensitive recording paper as claimed in claim 5, wherein the amount of colloidal silica and amorphous silica present in said coating layer is from about 0.1 to 5 parts by weight based on 1 part by weight of said modified polyvinyl alcohol containing silicon.

7. A heat-sensitive recording paper as claimed in claim 1, wherein said coating layer is coated in an amount of from about 0.2 to 5.0 g/m$^2$.

8. The heat-sensitive recording paper as claimed in claim 7, wherein said coating layer is coated in an amount of from about 0.5 to 3 g/m$^2$.

* * * * *